US011397057B2

(12) United States Patent
Lin

(10) Patent No.: US 11,397,057 B2
(45) Date of Patent: Jul. 26, 2022

(54) VAPOR CHAMBER STRUCTURE

(71) Applicant: Asia Vital Components Co., Ltd., New Taipei (TW)

(72) Inventor: Sheng-Huang Lin, New Taipei (TW)

(73) Assignee: Asia Vital Components Co., Ltd.

( * ) Notice: Subject to any disclaimer, the term of this patent is extended or adjusted under 35 U.S.C. 154(b) by 450 days.

(21) Appl. No.: 14/497,327

(22) Filed: Sep. 26, 2014

(65) Prior Publication Data

US 2016/0091259 A1 Mar. 31, 2016

(51) Int. Cl.
*F28D 15/04* (2006.01)
*F28D 15/02* (2006.01)

(52) U.S. Cl.
CPC ..... *F28D 15/046* (2013.01); *F28D 15/0233* (2013.01)

(58) Field of Classification Search
CPC ..... F25D 15/046; H01L 2924/0002; H01L 2924/00; H01L 21/4882; H01L 23/373; H01L 23/427; H01L 23/473; B22F 2998/00; B22F 3/1103; F28D 15/046; F28D 15/04; F28D 15/0233; F28D 15/0275; F28F 2013/006; F28F 2275/02; F28F 2275/04; H05K 7/20254; H05K 7/2029
See application file for complete search history.

(56) References Cited

U.S. PATENT DOCUMENTS 4,046,190 A * 9/1977 Marcus ..... F28D 15/0233 165/104.26
4,106,188 A * 8/1978 Sekhon ..... H01L 23/42 257/E23.087
6,082,443 A 7/2000 Yamamoto et al.
6,167,948 B1 * 1/2001 Thomas ..... F28D 15/02 165/104.26
6,874,568 B2 * 4/2005 Lai ..... F28D 15/0233 165/104.26
6,880,626 B2 * 4/2005 Lindemuth ..... B22F 7/004 165/104.26
6,906,413 B2 * 6/2005 Bish ..... H01L 23/10 257/706

(Continued)

FOREIGN PATENT DOCUMENTS

CN 101004333 A 7/2007
CN 103398613 A 11/2013

(Continued)

OTHER PUBLICATIONS

Search Report dated Jun. 3, 2016 issued by Taiwan Intellectual Property Office for counterpart application No. 103130342.

*Primary Examiner* — Elizabeth J Martin
(74) *Attorney, Agent, or Firm* — Bradley J. Thorson; DeWitt LLP

(57) ABSTRACT

A vapor chamber structure includes a main body. The main body has a chamber. The chamber has a first side, a second side and a connection body. Two axial ends of the connection body are respectively connected with the first and second sides. A first capillary structure layer is disposed around the connection body along a periphery thereof. A working fluid is filled in the chamber. The connection body serves to prevent the main body from deforming when heated and enhance the heat conduction efficiency.

8 Claims, 6 Drawing Sheets

(56) References Cited

U.S. PATENT DOCUMENTS 6,935,022 B2 * 8/2005 German ..... F28D 15/0275 165/104.26
6,945,317 B2 * 9/2005 Garner ..... F28D 15/0233 165/104.26
6,957,692 B1 * 10/2005 Win-Haw ..... F28D 15/0233 165/104.21
6,994,152 B2 * 2/2006 Rosenfeld ..... B22F 3/1103 165/104.21
7,223,638 B2 * 5/2007 Starkston ..... H01L 23/04 257/E23.021
7,447,029 B2 * 11/2008 Lai ..... H01L 23/427 165/104.21
7,556,086 B2 * 7/2009 Joshi ..... F28D 15/0233 165/104.17
7,599,185 B2 * 10/2009 Meyer, IV ..... H01L 23/427 165/104.21
7,650,931 B2 * 1/2010 Siu ..... F28D 15/0233 165/104.26
8,482,919 B2 * 7/2013 Dede ..... H01L 23/473 165/80.4
8,482,921 B2 * 7/2013 Cai ..... F28D 15/0266 165/104.26
8,792,238 B2 * 7/2014 Meyer, IV ..... F28D 15/0275 165/104.21
8,985,197 B2 * 3/2015 Wang ..... F28D 15/0233 165/104.21
9,029,991 B2 * 5/2015 Warren ..... H01L 21/4828 257/676
9,423,192 B2 * 8/2016 Tsoi ..... F28D 15/0233
2003/0173064 A1 * 9/2003 Ueki ..... F28D 15/0233 165/104.21
2004/0238944 A1 * 12/2004 Bish ..... H01L 23/10 257/706
2006/0118280 A1 * 6/2006 Liu ..... H01L 23/427 165/104.33
2007/0217154 A1 * 9/2007 Lai ..... H01L 23/427 361/700
2007/0294892 A1 * 12/2007 Yang ..... B23P 15/26 29/890.032
2008/0236795 A1 * 10/2008 You ..... H01L 23/427 165/104.21
2009/0025910 A1 * 1/2009 Hoffman ..... F28D 15/046 165/104.26
2009/0294104 A1 * 12/2009 Lin ..... F28D 15/0233 165/104.26
2010/0319895 A1 * 12/2010 Chen ..... F28D 15/046 165/185
2011/0108245 A1 * 5/2011 Tan ..... F28D 15/04 165/104.26
2011/0259555 A1 * 10/2011 Yang ..... F28D 15/0233 165/104.26
2012/0031587 A1 * 2/2012 Huang ..... F28D 15/046 165/104.26
2012/0031588 A1 * 2/2012 Huang ..... F28D 15/046 165/104.26
2012/0305222 A1 * 12/2012 Yang ..... F28D 15/046 165/104.26
2012/0305223 A1 * 12/2012 Yang ..... F28D 15/046 165/104.26
2013/0025829 A1 * 1/2013 Huang ..... F28D 15/046 165/104.26
2013/0037242 A1 * 2/2013 Chen ..... F28D 15/046 165/104.26
2013/0042999 A1 * 2/2013 Yang ..... F28D 15/0233 165/67
2013/0098592 A1 * 4/2013 Yang ..... B21D 53/02 165/185
2013/0199757 A1 * 8/2013 Meyer, IV ..... F28D 15/0275 165/104.26
2013/0213610 A1 * 8/2013 Wu ..... F28D 15/0233 165/104.26
2013/0213611 A1 * 8/2013 Wu ..... F28D 15/0233 165/104.26
2013/0213612 A1 * 8/2013 Wu ..... F28D 15/046 165/104.26
2013/0306274 A1 * 11/2013 Yang ..... F28D 15/02 165/104.21
2013/0306275 A1 * 11/2013 Yang ..... F28D 15/02 165/104.21
2014/0174704 A1 * 6/2014 Lin ..... F28D 15/0233 165/185
2014/0190667 A1 * 7/2014 McGlen ..... F28D 15/046 165/104.26
2015/0027668 A1 * 1/2015 Yang ..... F28D 15/04 165/104.26

FOREIGN PATENT DOCUMENTS

JP 200035294 A 2/2000
JP 2002231867 A 8/2002
TW M327021 U 2/2008
TW 201321706 A 6/2013
TW M495711 U 2/2015

* cited by examiner

VAPOR CHAMBER STRUCTURE

BACKGROUND OF THE INVENTION

1. Field of the Invention

The present invention relates generally to a vapor chamber structure, and more particularly to a vapor chamber structure includes a main body and a connection body. The connection body serves to support the main body and prevent the main body from deforming when heated. Also, the connection body is able to enhance the heat conduction efficiency of the vapor chamber structure.

2. Description of the Related Art

Recently, the operation performances of the mobile phones, personal computers, servers and communication chasses have become higher and higher. As a result, the heat generated by the internal calculation units of these electronic devices has become higher and higher. Under such circumstance, a heat dissipation unit is needed to help in dissipating the heat. Most of the manufacturers select heat sinks, heat pipes, vapor chambers and the like heat dissipation components to cooperate with a cooling fan for dissipating the heat. In the case that a large area needs to be cooled, a vapor chamber is used to absorb the heat. The vapor chamber can be co-used with a heat sink and a cooling fan to forcedly dissipate the heat. The respective heat dissipation components must be tightly attached to each other so as to avoid thermal resistance. The vapor chamber is a flat plate body having an internal chamber. A working fluid is filled in the chamber to carry out liquid-vapor circulation for conducting the heat. In order to prevent the flat-plate-shaped vapor chamber from expanding or deforming when pressurized or heated, multiple support columns are disposed in the chamber to support the vapor chamber.

The vapor chamber serves to transfer heat face-to-face. As aforesaid, multiple support columns are disposed in the chamber to support the vapor chamber and prevent the vapor chamber from expanding or deforming when heated or under an external force. The manufacturing process requires additional time and material to manufacture the support columns. Therefore, the manufacturing cost is increased. In the case that multiple copper columns coated with sintered rings are used as the support columns, the sintered rings only provide a backflow circulation effect and it is hard to control the planarity of the bottoms of the copper columns. Alternatively, copper columns with multiple channels can be used as the support columns to provide supporting and backflow circulation effects. It is also hard to control the planarity of the bottoms of the copper columns with multiple channels. Therefore, although the conventional technique can solve the problem of deformation, the manufacturing time is prolonged and the manufacturing cost is increased and it is hard to control the planarity of the bottoms of the copper columns.

SUMMARY OF THE INVENTION

It is therefore a primary object of the present invention to provide a vapor chamber structure that includes a main body. The main body has a chamber. The chamber has a first side, a second side and a board-shaped connection body. Two axial ends of the board-shaped connection body are respectively connected with the first and second sides. A first capillary structure layer is disposed around the board-shaped connection body along a periphery thereof. A working fluid is filled in the chamber.

The board-shaped connection body serves to prevent the main body from expanding and deforming when heated and prevent the main body from contracting and deforming when pressurized. Moreover, the vapor chamber structure of the present invention overcomes the problem of the conventional vapor chamber that it is hard to control the planarity of the bottoms of the copper columns. Therefore, the present invention is advantageous over the conventional vapor chamber in that the manufacturing time is shortened and the manufacturing cost is lowered and the heat conduction efficiency is enhanced.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
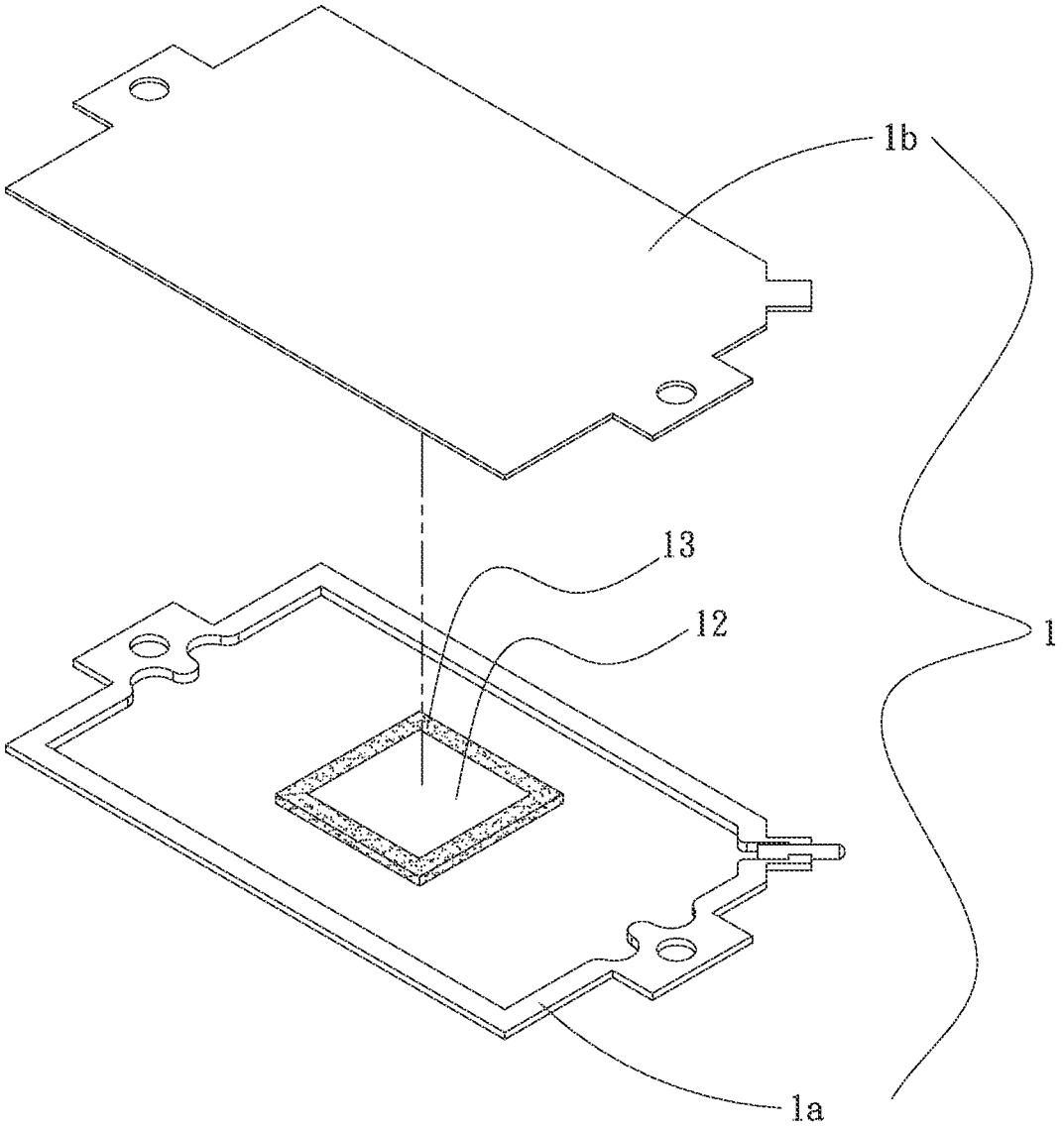
FIG. 1 is a perspective exploded view of a first embodiment of the vapor chamber structure of the present invention.
Figure 2:
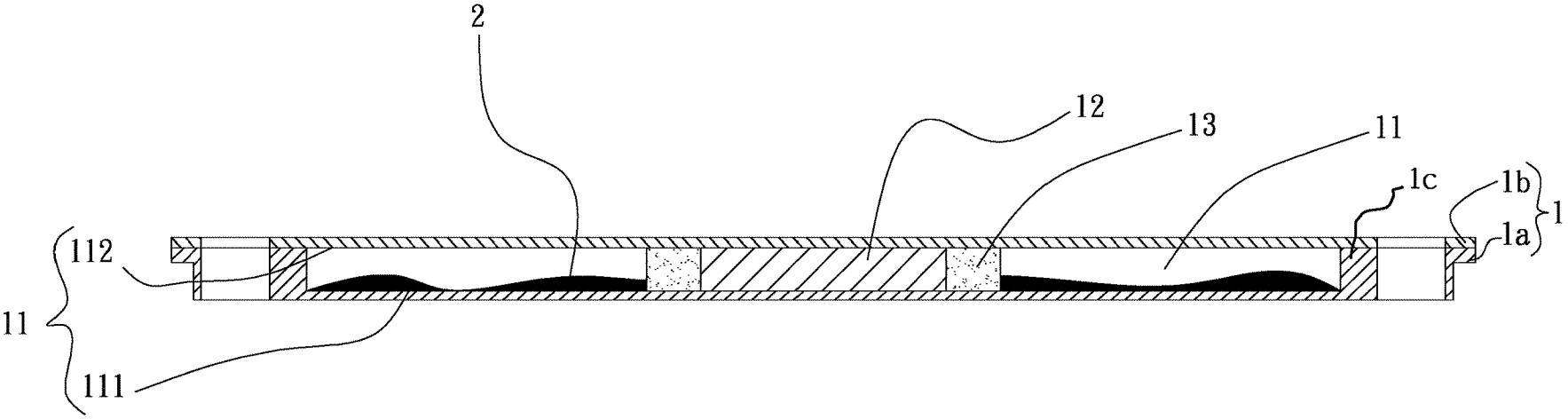
FIG. 2 is a sectional assembled view of the first embodiment of the vapor chamber structure of the present invention.

Please refer to FIGS. 1 and 2. FIG. 1 is a perspective exploded view of a first embodiment of the vapor chamber structure of the present invention. FIG. 2 is a sectional assembled view of the first embodiment of the vapor chamber structure of the present invention. As shown in the drawings, the vapor chamber structure of the present invention includes a main body 1.

The main body 1 has a chamber 11 formed between a first side 111 and a second side 112. The first and second sides 111, 112 are jointed to one another by a peripheral wall 1*c*, and a solid board-shaped connection body 12 is provided and contained within the chamber 11. Two axial ends of the board-shaped connection body 12 are respectively connected with the first and second sides 111, 112. A first capillary structure layer 13 is disposed on a peripheral surface of the board-shaped connection body 12 along a periphery thereof. A working fluid 2 is filled in the chamber 11. The first capillary structure layer 13 is a sintered powder body.

The main body 1 includes a base member 1*a* and a cover member 1*b*. The base member 1*a* and the cover member 1*b* are correspondingly joined together by the peripheral wall 1*c* to define the chamber 11 therebetween.

The board-shaped connection body 12 is a metal board body made of copper material, aluminum material or other good heat conductor. In this embodiment, the board-shaped connection body 12 is, but not limited to, made of copper material for illustration purposes.

The first capillary structure layer 13 is a sintered powder body. The first capillary structure layer 13 has a geometrical configuration selected from a group consisting of square, rectangular, trapezoidal and circular shapes. In this embodiment, the configuration of the first capillary structure layer 13 is, but not limited to, square shape for illustration.

The board-shaped connection body 12 has a geometrical configuration selected from a group consisting of square, rectangular, trapezoidal and circular shapes. In this embodiment, the configuration of the board-shaped connection body 12 is, but not limited to, square shape for illustration.

Figure 3:
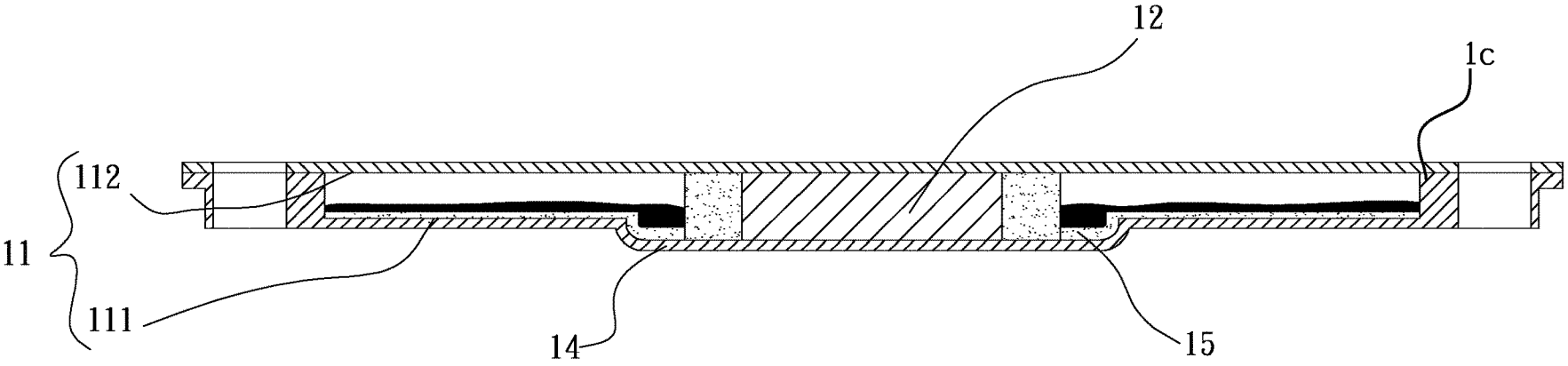
FIG. 3 is a sectional assembled view of a second embodiment of the vapor chamber structure of the present invention.

Please now refer to FIG. 3, which is a sectional assembled view of a second embodiment of the vapor chamber structure of the present invention. The second embodiment is partially identical to the first embodiment in structure and thus will not be repeatedly described hereinafter. The second embodiment is different from the first embodiment in that the main body 1 further has a recessed heated section 14 formed on the first side 111 or the second side 112. In this embodiment, the recessed heated section 14 is formed on the first side 111. The board-shaped connection body 12 is disposed on the heated section 14. The first and second sides 111, 112 are further provided with a second capillary structure layer 15. The thickness of the second capillary structure layer 15 in the heated section 14 is thicker than the thickness of the second capillary structure layer 15 in a non-heated section.

Figure 4:
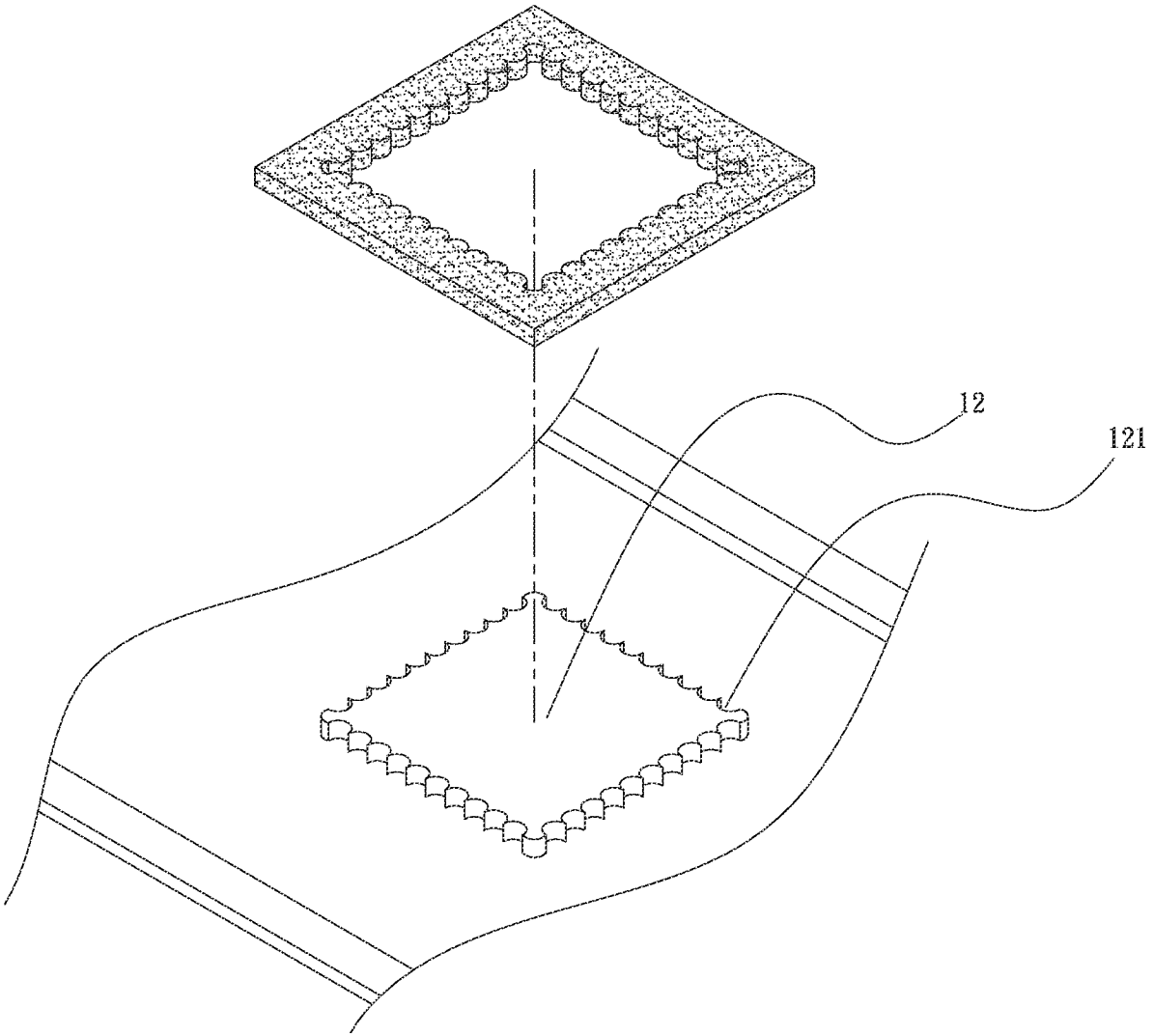
FIG. 4 is a perspective exploded view of a third embodiment of the vapor chamber structure of the present invention.

Please now refer to FIG. 4, which is a perspective exploded view of a third embodiment of the vapor chamber structure of the present invention. The third embodiment is partially identical to the first embodiment in structure and thus will not be repeatedly described hereinafter. The third embodiment is different from the second embodiment in that the periphery of the board-shaped connection body 12 is formed with multiple recesses 121.

Figure 5:
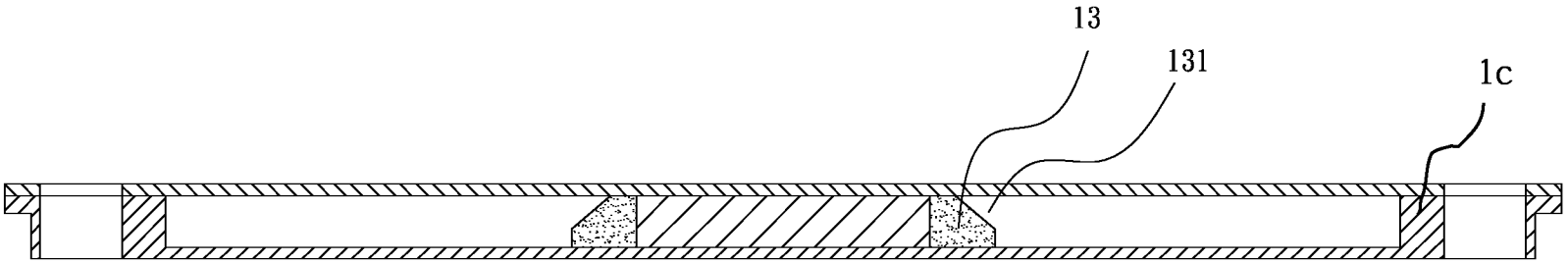
FIG. 5 is a sectional assembled view of a fourth embodiment of the vapor chamber structure of the present invention.

Please now refer to FIG. 5, which is a sectional assembled view of a fourth embodiment of the vapor chamber structure of the present invention. The fourth embodiment is partially identical to the first embodiment in structure and thus will not be repeatedly described hereinafter. The fourth embodiment is different from the second embodiment in that the first capillary structure layer 13 further has a downward and outward inclination 131 extending from the cover member 1*b* toward the base member 1*a* for facilitating spreading of the vapor working fluid 21.

Figure 6:
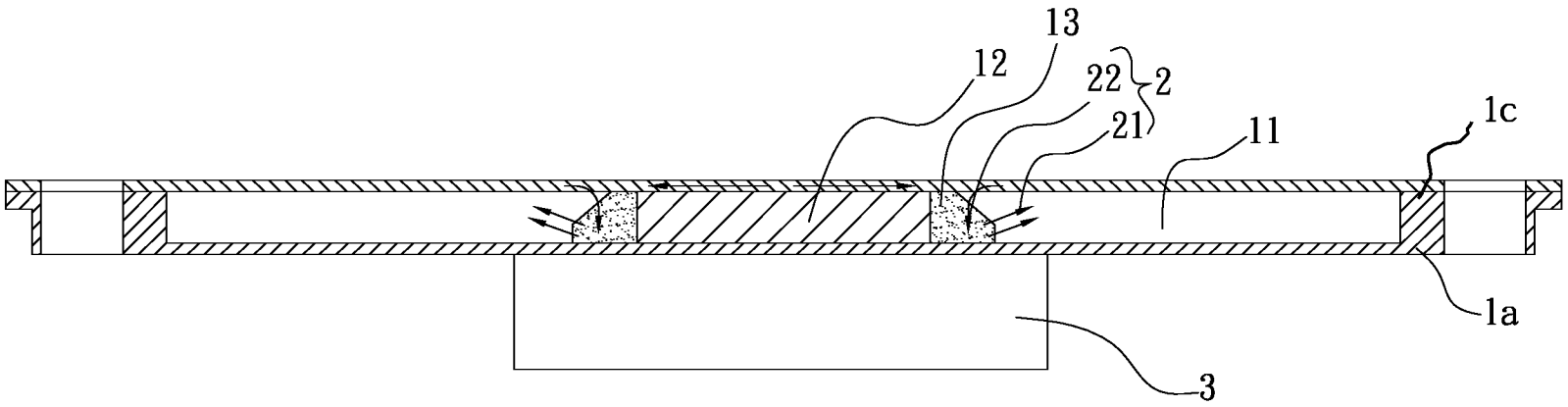
FIG. 6 is a sectional assembled view showing the vapor chamber structure of the present invention.

Please now refer to FIG. 6, which is a sectional assembled view showing the vapor chamber structure of the present invention. The main body 1 is in contact with at least one heat source 3. A section of the main body 1 where the board-shaped connection body 12 is disposed is chosen as a main contact section in contact with the heat source 3. The board-shaped connection body 12 serves to support the section of the main body 1 to avoid deformation of the main body 1 when the main body 1 is tightly attached to the heat source 3.

Moreover, when the main body 1 absorbs the heat of the heat source 3 to conduct the heat, the first board body 1*a* directly transfers the heat to the board-shaped connection body 12 as well as the working fluid 2 in the chamber 11. After absorbing the heat, the liquid working fluid 22 changes into vapor working fluid 21 to start liquid-vapor circulation. The heat is mainly transferred by the board-shaped connection body 12. The liquid working fluid 22 is evaporated into vapor working fluid 21, which is spread from the first capillary structure layer 13. The liquid working fluid 22 flows back through the first capillary structure layer 13. Accordingly, an excellent heat dissipation effect is achieved.

The present invention has been described with the above embodiments thereof and it is understood that many changes and modifications in the above embodiments can be carried out without departing from the scope and the spirit of the invention that is intended to be limited only by the appended claims.

What is claimed is:

1. A vapor chamber structure comprising a main body having a base member and a cover member joined together by a peripheral wall to define a chamber therebetween and contained within the chamber and extending between the base member and the cover member being provided a single solid connection body having a first capillary structure layer disposed on a peripheral surface of the single solid connection body, the chamber being further filled with a working fluid, the first capillary structure layer having a downward and outward inclination extending from the cover member toward the base member for facilitating spreading of vaporized working fluid.

2. The vapor chamber structure as claimed in claim 1, wherein the solid connection body is a metal body.

3. The vapor chamber structure as claimed in claim 2, wherein the solid connection body is a metal body made of copper material, or aluminum material.

4. The vapor chamber structure as claimed in claim 1, wherein the first capillary structure layer is a sintered powder body.

5. The vapor chamber structure as claimed in claim 1, wherein the solid connection body has a cross section of a geometrical configuration selected from a group consisting of square, rectangular, trapezoidal and circular shapes.

6. The vapor chamber structure as claimed in claim 5, wherein the first capillary structure layer has a geometrical configuration matching that of the solid connection body.

7. A vapor chamber structure comprising a main body, the main body having a chamber formed between a first side and a second side, the first and second sides joined to one another by a peripheral wall and a single solid connection body contained within the chamber, two axial ends of the single solid connection body being respectively connected with the first and second sides, a first capillary structure layer being disposed around the single solid connection body along a periphery thereof, a working fluid being filled in the chamber, wherein one of the first and second sides of the main body further has a recessed section that is adapted to be heated by an electronic component, the solid connection body being disposed on the recessed section, the first and second sides having a second capillary structure layer, the thickness of the second capillary structure layer in the recessed section being thicker than the thickness of the second capillary structure layer in a non-recessed section.

8. A vapor chamber structure comprising a main body, the main body having a chamber, the chamber having a first side and a second side joined to one another by a peripheral wall and a single solid connection body contained therein, two axial ends of the single solid connection body being respectively connected with the first and second sides, a first capillary structure layer being disposed around the single solid connection body along a periphery thereof, and wherein the periphery of the solid connection body is formed with multiple recesses.

* * * * *